United States Patent [19]

Kempster

[11] 4,067,128

[45] Jan. 10, 1978

[54] TAXI INDICATOR

[76] Inventor: Breier B. Kempster, 24 Hume Street, Adelaide, Australia, 5000

[21] Appl. No.: 674,135

[22] Filed: Apr. 6, 1976

[51] Int. Cl.[2] ..... G09F 11/02

[52] U.S. Cl. ..... 40/473; 40/502; 40/500; 40/532; 40/572

[58] Field of Search ..... 40/52, 77, 129 C; 340/107, 68

[56] References Cited

U.S. PATENT DOCUMENTS

| | | | |
|---|---|---|---|
| 973,372 | 10/1910 | Miller | 40/77.9 |
| 994,992 | 6/1911 | Fisher | 40/52 R |
| 1,222,658 | 4/1917 | Naylor | 40/52 R |
| 1,715,172 | 5/1929 | Ollerenshaw | 40/52 R |
| 1,728,746 | 9/1929 | Cannella | 40/52 R |
| 1,834,700 | 12/1931 | Grassman | 40/52 R |
| 2,173,329 | 9/1939 | Geiser | 40/52 R |
| 2,783,451 | 2/1957 | Stout | 340/68 |
| 2,814,028 | 11/1957 | Hamilton | 340/68 |

*Primary Examiner*—Russell R. Kinsey
*Assistant Examiner*—Wenceslao J. Contreras
*Attorney, Agent, or Firm*—Oldham & Oldham Co.

[57] ABSTRACT

An indicator for a taxi-cab, the indicator having a plurality of different displays to be shown through a window, there being control means in the vehicle to control which display is visible through the window.

3 Claims, 4 Drawing Figures

TAXI INDICATOR

This invention relates to an indicator for taxis, which has been devised to show when a taxi is vacant and when it is not for hire.

BACKGROUND OF INVENTION

It is already known to use in connection with taxis indicator means which are adapted to show whether a taxi is vacant and therefore available for hire or whether it is engaged and thus unavailable for hire.

Such an indicator serves a useful purpose in that persons wishing to hail a taxi can readily do so when a sign is displayed that the taxi is vacant, and of course there are cases where a taxi may be stationary but engaged and on such condition it is again advantageous to be able to display that the taxi is not for hire.

The method usually adopted for such a device is to have an indicator within the taxi itself which is visible through perhaps the windscreen and which can be set by the operator to show either the sign "Vacant" or "Not for Hire," but such a device is not readily visible because of its location and there is now a requirement for the unit which will be more readily visible to persons wishing to hire a taxi yet which will be simple to operate and will provide the required information.

SUMMARY OF INVENTION

The device according to this invention comprises a housing having at least one window through which is displayed an indicator which can have a plurality of positions to display information contained on the indicator through the window or windows.

The indicator is operated electromagnetically when one indication is required it is only necessary to move a switch or control member and the indicator will move appropriately when the indication is to be changed the member will be moved to a different position and the indicator will be moved magnetically, means being provided to cut off the energising current from the magnetic mechanism each time the indicator has been moved to its new position, an over-balancing spring type of lock being used to hold the device in any one of its indicating positions.

While it will be realised that the invention can be widely varied within the general principles set out above, an embodiment will now be described in more detail but it is to be clear that the invention need not necessarily be limited to such details.

Figure 1:
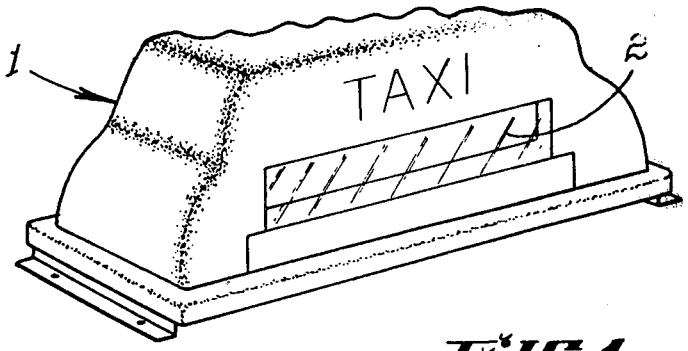
Figure 2:
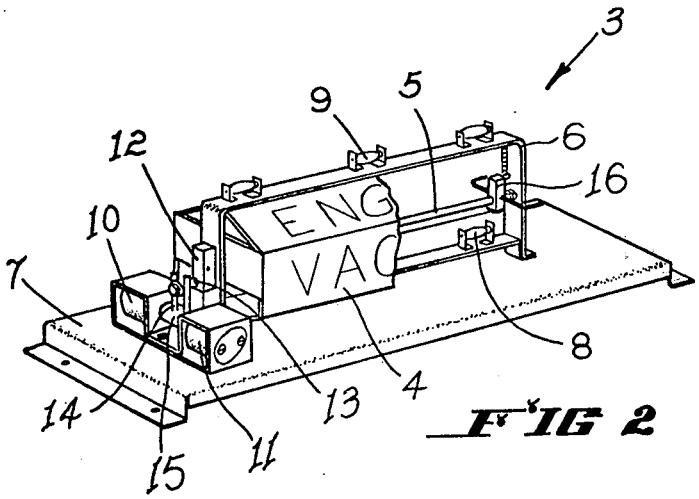
Figure 3:
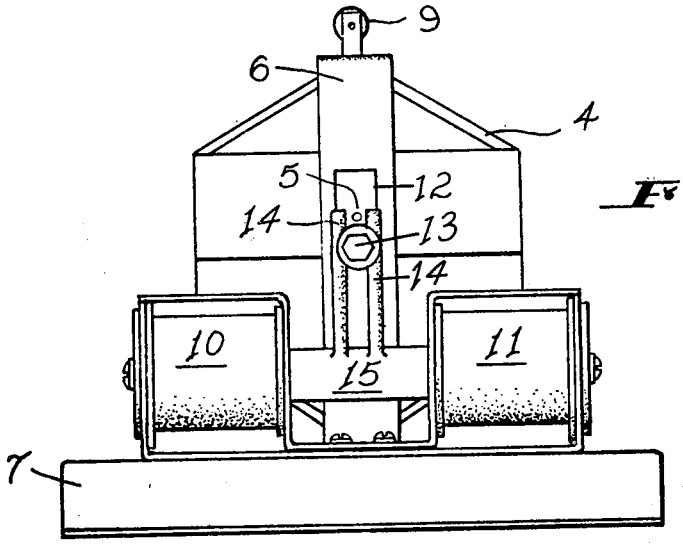
Figure 4:
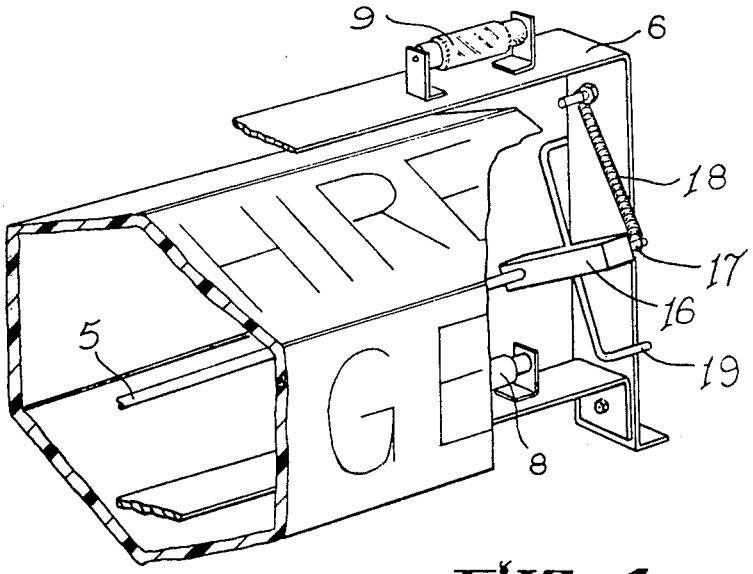

FIG. 1 is a general view of the indicator adapted to be fitted to the roof of a vehicle, FIG. 2 is a perspective view of the indicator with the housing removed and parts broken away for clarity, FIG. 3 is an end view of the interior of the indicator, and FIG. 4 is a part view of the portion of the interior of the indicator.

According to this preferred embodiment the indicator is arranged so that it may be mounted on top of a taxi at any appropriate location, the housing 1 having in it a front window 2 and rear window (not shown) between which is situated the indicator mechanism 3 which includes hollow body 4 of hexagonal cross-section and is mounted to orientate about a central longitudinal axis from a supporting shaft 5 carried by a frame 6 which is attached to a base 7 which supports the housing 1, the base having provision for means to attach the base to the vehicle roof.

Displayed on the hollow body are the "Vacant," "Engaged" and "Not for Hire" signs and it will be realised therefore when the indicator is in one position, the required designation will be visible forwardly and rearwardly through the windows in the housing, the same being true when either of the other indications are required at which stage the indicator is turned through 60° from its central position in either direction to display the other faces of the hollow body which forms the indicator.

Within the hollow body 4 are lights 8 which illuminate the sign and these or further lights 9 can also illuminate the inside of the housing itself which preferably has the word "Taxi" on its forward and rearward faces above the windows 2.

The mechanism for operating the device preferably comprises switch means within the vehicle wired to a pair of solenoids 10, 11 on the indicator.

The solenoids 10, 11 can conveniently be positioned one on each side of the centre line of the body 4 which is to be rotated and coupled thereto by a crank 12 which engages the shaft 5 of the hollow body 4 which forms the indicator. The crank 12 has a crank pin 13 engaged between a pair of guides 14 fixed to a rod 15 being the movable core or armature of the solenoids 10 and 11.

Thus when neither solenoid is engaged the body is in its central position with the "Vacant" sign indicated. If solenoid 10 is activated the body is turned through 60° to bring the "Engaged" sign into view, while if solenoid 11 is activated the body is rotated back to show the "Not for Hire" sign.

On the opposite end of the indicator to the solenoids, is a body 16 which is fixed to turn with the indicator body or shaft 5 and this has on it a pin 17 above the rotational axis and a spring 18 from the pin to the frame 6 of the unit so that the body will be biased to its central position. A pair of arms 19 on the body 16 are adapted to engage the frame 6 to limit the movement in either direction of rotation. In order to assist in maintaining the body in its central position, there may be provided between the crank 12 and the frame 6, a detent in the form of a spring loaded ball and recess (not shown) to firmly retain the body 5 in its central position. In this way in its central position neither solenoid is activated, while in its turned position the appropriate solenoid is activated to move and hold the body 4 in its turned position.

Alternatively the member 16, which turns with the sign can have a pair of faces which are adapted to contact cut off switches, and these can also form stop means to hold the body in either of its rotated positions, these switches being wired in series with the solenoids so that when the solenoid is actuated and pulls the indicator and thus the member which turns with the indicator through 60°, the appropriate cut out switch is contacted to open the circuit and thus cut off the supply of the solenoid which at the time was moving the indicator to its position.

The unit then stays in this way and can only be again activated by operating a switch to change the sign to its other designation, because at that stage the cut out switch relevant to the next change is in its closed position and the appropriate solenoid can be actuated.

So far as the lighting is concerned this is preferably taken from the supply to the meter in the taxi so that only when the meter is in operation will the sign light up, thus enabling the taxi to operate without displaying any sign when being used other than for taxi work.

It will be realised, as stated earlier herein, that actual details of construction of such a device can be quite considerably varied, but it will readily be appreciated that a device which can be secured on the top of the taxi, and which will be readily visible from outside of the taxi, will give a clear indication of whether the taxi is for hire or not, and obviously such a device will serve a very useful function and at the same time be readily operated by the driver of the taxi in a simple manner, no mechanical connection being necessary between the control means and the indicating device as the unit can readily be actuated by means of the solenoids and because of the particular construction, will not require further attention from the operator because after initiation of a change in the indicator, the solenoids will swing the indicator into the required position and in the alternative form, the cut out switch will then de-energise that solenoid but will automatically leave the other solenoid in a state such that it can be energised when the control switch is changed.

If desired the control switch could be provided with indicator means which show the condition of the sign at the top of the taxi.

It is preferred however that the switching means be connected to the meter, so that only a single action is required by the driver so that the actuation of the meter automatically changes over the indicator. This then is simpler for the driver so that he does not have to perform an additional function and also ensures that the indicator on the taxi is in agreement with the condition of the meter itself.

It will be realised that the body 4 has the appropriate information displayed twice, so that as the housing has fore and aft windows, that the condition of the taxi is displayed both fore and aft of the taxi. Preferably also the body 4 is so dimensioned in relation to the housing and the windows that the sides of the body 4 are positioned relatively close to the windows while still allowing the body 4 to rotate.

It will be realised also that the indicator can display only sets of information, that is "Engaged" and "Vacant" and it will be seen that the solenoids would have two positions only to rotate the body through 90° instead of 60°.

Also it is within the concepts of the invention to display the information in one direction only, for example fowardly and thus the body and housing would be such that only one window is required and if desired the body could be formed or suitably modified to display this information forwardly only.

The device can be constructed of plastic and if desired could be of clear plastic with areas over printed by means of a silk screen process or the like to give the necessary window opening but to allow sufficient light to issue to allow ready reading of the indicator.

I claim:

1. An indicator for a taxi cab, comprising a housing, means to fix the housing to an exterior surface of the vehicle, the housing having at least one window through which can be displayed, a rotatable indicator having a plurality of positions to display alternate information relating to the condition of the taxi, means to move the indicator through a limited arc including a pair of solenoids interconnected by a rod forming the armature for the solenoids, a pair of spaced guides attached to and projecting from the rod to slidably engage therebetween a crank pin on a crank mounted on the indicator, the solenoids moving the rod longitudinally from a central position whereby the rod movement causes partial rotation of the indicator to its said positions.

2. An indicator as defined in claim 1 wherein the guides are parallel and the crank pin is offset from the axis of a shaft on which the indicator is positioned.

3. An indicator for a taxi cab, comprising a housing, means to fix the housing to an exterior surface of the vehicle, the housing having two windows, one adapted to face forwardly of the taxi and the other adapted to face rearwardly, and an indicator having a plurality of positions to display alternate information relating to the condition of the taxi and a plurality of portions, corresponding portions having similar information whereby the same information is displayed simultaneously through both windows, the indicator being a hexagonal cylinder situation with its faces adapted to be adjacent the windows, and means to move the indicator positively through an arc of 180° or less in both directions to display alternate faces through the window.

the indicator being reciprocated through an arc by means including a pair of solenoids interconnected by an armature rod, the rod having slide connector means thereon engaging a pin on a crank attached to a shaft on which the indicator is mounted to move the indicator shaft through arcs by reciprocating movement of the armature rod transmitted by the connector means, crank and pin to the shaft.

* * * * *